United States Patent [19]

Grossmeyer

[11] Patent Number: 4,576,484

[45] Date of Patent: Mar. 18, 1986

[54] MEMORY ENHANCING APPARATUS

[76] Inventor: Mark C. Grossmeyer, N49 W6757 Western Rd., Cedarburg, Wis. 53012

[21] Appl. No.: 628,169

[22] Filed: Jul. 5, 1984

[51] Int. Cl.[4] ..... G04B 23/02

[52] U.S. Cl. ..... 368/245; 368/246

[58] Field of Search ..... 368/245, 246, 244

[56] References Cited

U.S. PATENT DOCUMENTS 4,060,973 12/1977 Martino ..... 368/245

FOREIGN PATENT DOCUMENTS 141669 12/1978 Japan ..... 368/245
0060382 5/1981 Japan ..... 368/245
55886 5/1981 Japan ..... 368/245
0081485 7/1981 Japan ..... 368/245
30979 2/1982 Japan ..... 368/245
0067889 4/1982 Japan ..... 368/245

*Primary Examiner*—Bernard Roskoski
*Attorney, Agent, or Firm*—Larry L. Shupe

[57] ABSTRACT

The disclosed memory enhancing apparatus includes an oscillating section for generating a plurality of first signals. A counting section is coupled to the oscillating section for receiving the first signals and responsively generating a plurality of second signals having time intervals therebetween, each of the time intervals having a duration different from that of the immediately preceding interval. A dividing section is coupled to the counting section and includes means for varying the frequency of the first signals while an output section is coupled to the counting section for providing a reminding signal in response to each of the second signals.

9 Claims, 2 Drawing Figures

MEMORY ENHANCING APPARATUS

BACKGROUND OF THE INVENTION

This invention relates generally to horological devices and more particularly to a personal memory apparatus for emitting a plurality of sequentially occurring reminding signals for enhancing the memory of the user.

Timing and alarm apparatus are in wide use for reminding a user to attend to a particular task. For example, U.S. Pat. No. 4,361,408 discloses a timer and alarm apparatus suitable for complementary use with medication containers. The user may preselect a desired time interval and an alarm signals the conclusion thereof by emitting a plurality of signals equally spaced apart in time. A reset unit permits reinitiation of a next successive interval. While the time interval selected by the user may vary, all intervals, once selected, are of the same duration.

U.S. Pat. No. 4,192,133 describes a watch having means for generating an audible signal upon the lapse of each consecutively-occurring time interval, each interval having the same preselected duration. A signal occurs on each occasion when the time progression of a counter is coincident with a time stored in the watch memory unit.

Yet another type of signal-emitting device is described in U.S. Pat. No. 4,244.042 and is arranged for emitting an audible alarm at a preset time. When manually disabled and reset, the device is thereby automatically caused to emit a signal at the next preset alarm time. If no manual disablement occurs, the signal is automatically silenced after a predetermined duration.

While these known devices may be employed for a variety of signaling or alarm purposes, they have failed to appreciate or satisfy the need for a personal memory enhancing apparatus which, once actuated, will automatically provide a plurality of sequentially occurring signals to the user, the signals being spaced by time intervals of differing durations, thereby providing a sense of progressively decreasing or increasing urgency, depending upon the construction of the apparatus. It is known, for example, that human memory becomes more retentive if a thought to be recalled is repetitively and more rapidly reinforced at the onset. It is also known that, psychologically, a user will become annoyed by additional reminding signals equally spaced in time, once the thought is reinforced. This annoyance may cause the user to disable the apparatus with consequent risk of loss of the thought.

The aforementioned devices have also failed to appreciate how such an apparatus may be constructed of integrated circuits and subminiature components so that it is relatively small and may be unobtrusively carried upon the person.

SUMMARY OF THE INVENTION

The inventive memory enhancing apparatus includes an oscillating section for generating a plurality of first signals. A counting section is coupled to the oscillating section for receiving the first signals and responsively generating a plurality of second signals having time intervals therebetween, each of the time intervals having a duration different from that of the immediately preceding interval. A dividing section is coupled to the counting section and includes means for varying the frequency of the first signals while an output section is coupled to the counting section for providing a reminding signal in response to each of the second signals.

It is an object of the present invention to provide a memory enhancing apparatus adapted to emit reminding signals at differing intervals of time.

Another object of the present invention is to provide an apparatus for generating a signal sensed as one of progressively increasing or decreasing urgency, according to the apparatus construction.

Still another object of the present invention is to provide a memory enhancing apparatus which may be constructed at low cost and of small size to be carried about by or worn upon the person of the user. How these and other objects are accomplished will become more apparent from the detailed description thereof taken in conjunction with the accompanying drawing.

DETAILED DESCRIPTION OF THE EMBODIMENTS

Figure 1:
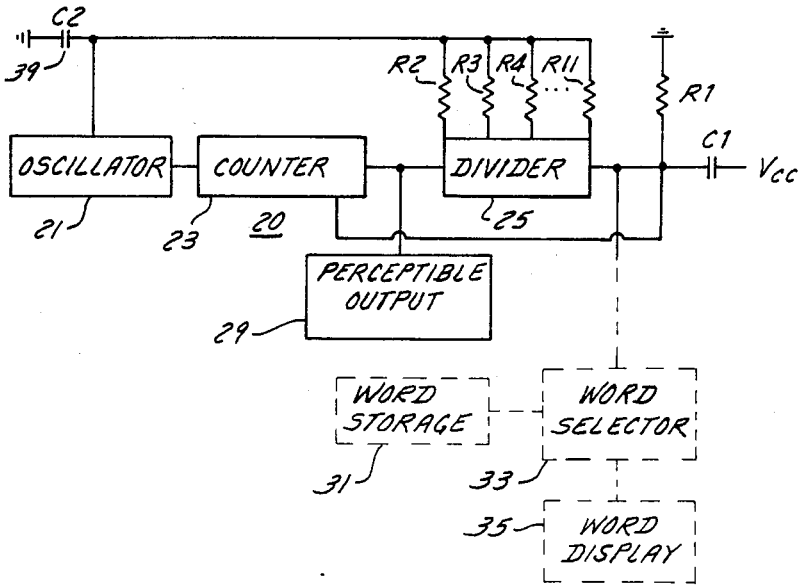
FIG. 1 is a block diagram of the apparatus of the present invention with optional portions shown in dotted outline.
Figure 2:
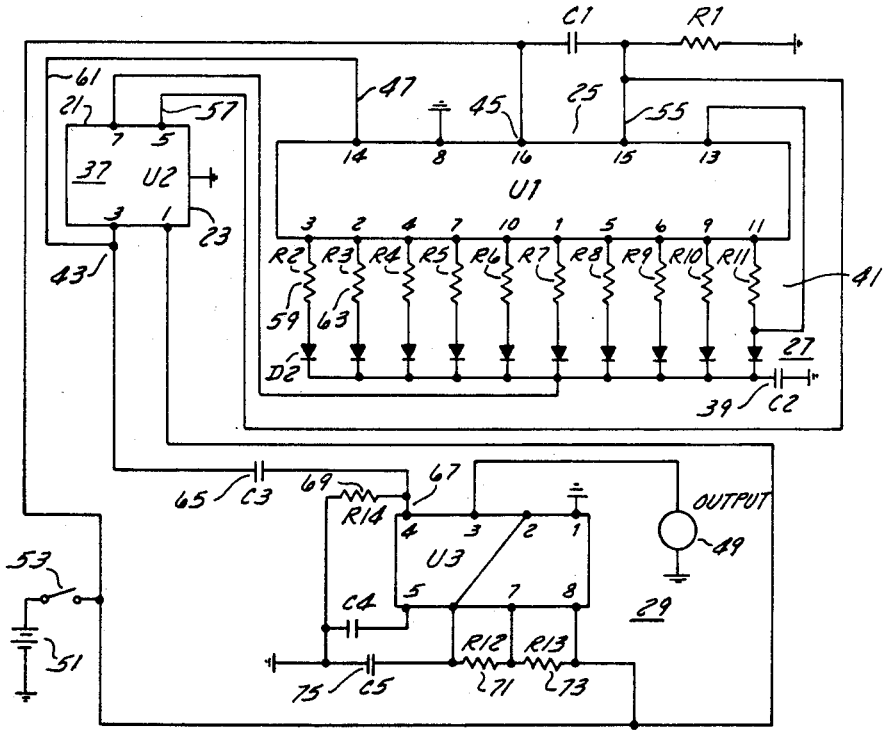
FIG. 2 is an electrical schematic diagram of a preferred embodiment of the inventive apparatus.

Referring to FIGS. 1 and 2, the memory-enhancing apparatus 20 of the present invention is shown to include an oscillating section 21 for generating a plurality of first signals. A counting section 23 is coupled to the oscillating section 21 for receiving the first signals and responsively generates a plurality of second signals having time intervals therebetween. Each of the time intervals has a duration different from the duration of the immediately-preceding interval. A dividing section 25 is coupled to the counting section 23 and includes means 27 for varying the frequencies of the first signals. An output section 29 is coupled to the counting section 23 for providing a reminding signal in response to each of the second signals. The reminding signal may be audible, tactile or visual in nature and, optionally, the apparatus 20 may also include means 31 for electronically storing a plurality of human-readable words, means 33 for randomly selecting one such word and means 35 for providing a visual display of the word selected.

Referring particularly to FIG. 2, the apparatus 20 is shown to include an oscillating section 21 and a counting section 23 preferably embodied as a combinative solid state circuit 37 of the type disclosed herein. The circuit 37 generates a plurality of sequentially occurring first signals which are internal to the circuit 37, each of these signals comprising a predetermined count or number of oscillatory cycles, 256 in the disclosed embodiment. The frequency at which these oscillatory cycles will occur will depend upon the value of the capacitor 39 and upon the value of the single resistor, one of the group 41 noted as resistors R2–R11, which then forms a part of the RC circuit coupled to the oscillating section 21 during a series of oscillatory cycles at a particular frequency. At the conclusion of the aforesaid predetermined count, a second signal will appear at the output pin 43 as a change in pin logic state from "0" to "1".

The section 25 is preferably configured so that a reset signal applied to its pin 45 will cause resistor 59 to be effectively coupled to the oscillating section 21 for determining oscillator frequency. Thereafter, each successive pulse emanating from the oscillating section 21 in the form of a change from logic "0" to logic "1" state and applied to pin 47 of the section 25 will cause the next succeeding resistor to be inserted to the section 25 and the preceding resistor to be removed therefrom, thereby establishing a new oscillator frequency.

Each of the second signals is received at the output section 29 which includes an output signaling device 49 for responsively providing a plurality of reminding signals. The device 49 may be embodied as a piezoelectric transducer for providing an audible signal or a vibrating member for providing a tactile signal. Referring additionally to FIG. 1 and in yet another embodiment of the invention, the apparatus 20 may further include word-storage means 31 such as a memory chip, word selector means 33 and word display means 35 such as an LCD readout panel for providing a visual reminding signal.

In operation, a battery 51 is selected to have a voltage compatible with the ratings of the sections 21, 23, 25, 29 and when the user desires to employ the apparatus 20 to aid in recalling, for example, a task to be performed or an appointment to be kept, the two-position maintained contact switch 53 is closed. A reset signal is thereby applied to reset pin 55 of the section 25 and to reset pin 57 of the oscillating section 21. Thereupon, the oscillating section 21 commences generation of a first signal at a frequency determined by the values of the R-C circuit comprised of resistor 59 and capacitor 39. At this instant and during the time that the first signal of the oscillating section 21 is making a predetermined number of oscillatory cycles, a count of 256 being exemplary, pin 43 of the oscillating section 21 is held at a logic "0" state. Following completion of the count, pin 43 is switched to a logic "1" state and is thereupon applied to pin 47 of the section 25 along line 61. This causes the dividing section 25 to index, removing the resistor 59 from the R-C circuit and inserting the resistor 63. Simultaneously with the occurrence of the logic "1" state at pin 43, that logic "1" second signal is applied through capacitor 65 to pin 67 of the output section 29. Whenever pin 67 is at logic "1", an output signal is applied to the device 49, thereby producing an audible, tactile or visually-perceptible output. Upon charging of the capacitor 65, current ceases to flow through the resistor 69, pin 67 reverts to logic "0" state and the output signal will cease. It is to be appreciated that the logic "1" state of pin 43 will persist for a relatively long period, about 128 counts in the exemplary embodiment. It will be further appreciated by those of ordinary skill that one may control the duration of the output signal by selection of the values of the capacitor 65 and the resistor 69. Further, the frequency (pitch) or vibratory rate of the output signal, whether audible or tactile respectively, may be determined by appropriate selection of the values of the resistors 71 and 73 and of capacitor 75.

Improved memory enhancement will result if sequential pairs of second signals and therefore sequential pairs of output signals are spaced by time intervals of differing durations. For example, the selection of progressively decreasing values for the group 41 of resistors R2–R11 will cause the generation of perceptible output signals which occur substantially coincidently with the occurrence of the aforedescribed second signals and which have time intervals therebetween of a duration shorter than the duration of all preceding intervals. The perception of the user is therefore one of increasing urgency. Conversely, if the resistors R2–R11 are selected to have progressively increasing values, those time intervals will be of progressively longer duration, thereby providing a reminding signal of progressively decreasing urgency. An advantage of the latter configuration relates to known physiological and psychological factors. That is, a thought may be better recalled if repetitively, rapidly reinforced at the onset while yet avoiding subsequent annoyance by diminishing the frequency of later reminding signals. Yet another configuration may use successive resistors R2–R11 of the group 41 selected to have alternately higher and lower values whereby sequential pairs of output signals will be spaced by time intervals of alternately increased and decreased durations.

It will appreciated by those of ordinary skill that one may simultaneously shift the values of all of the time intervals by modifying the value of the capacitor 39 and that the counting section 23 could be eliminated from the apparatus 20, albeit at the expense of significantly larger resistors comprising the group 41 and of a significantly larger capacitor 39. The following components have been found useful in the apparatus 20 where resistances are in ohms and capacitances are in microfarads unless otherwise specified.

FIG. 2

| | | | |
|---|---|---|---|
| U1 | CD4017 | U2 | ICM7242 |
| U3 | 7555 | C1 | 0.005 |
| C2 | 4.7 | C3 | 1.0 |
| C4 | 0.001 | C5 | 0.001 |
| R1 | 470K | R2 | 1K |
| R3 | 15K | R4 | 27K |
| R5 | 68K | R6 | 120K |
| R7 | 210K | R8 | 360K |
| R9 | 600K | R10 | 960K |
| R11 | 1.5M | R12 | 220K |
| R13 | 56K | R14 | 220K |
| D2 and all diodes | IN914 | Transducer for audible output - Radio Shack | 273-064 |

While only a few preferred embodiments have been shown and described herein, the invention is not intended to be limited thereby but only by the scope of the claims which follow.

I claim:

1. Memory enhancing apparatus including:

a solid state oscillating section for generating a plurality of sequentially occurring first signals, each of said first signals having a frequency different from that of the immediately preceding signal;

a solid state frequency counting section for receiving said plurality of first signals and responsively generating a plurality of sequentially occurring second signals having a duration substantially identical one to the other, each sequential pair of said second signals being spaced by time intervals of differing durations;

a solid state dividing section coupled to said counting section and including means for determining the frequencies of said first signals;

an output section coupled to said counting section for providing a sequence of reminding signals, each of said reminding signals being in response to one of said second signals, said remining signals being of equivalent duration and of equivalent pitch one to the other, and;

a switch coupled to said counting section, said oscillating section, said dividing section and said output section and operable by a user for actuating said apparatus, said apparatus automatically and indefinitely emitting a plurality of reminding signals upon actuation of said switch, the time of occurrence of said reminding signals being independent of the actual time, said reminding signals being initiated relatively soon after actuation by said user, said signals having a substantially constant volume.

2. The invention set forth in claim 1 wherein each of said time intervals has a duration longer than the duration of the immediately preceding interval.

3. The invention set forth in claim 1 wherein each of said time intervals has a duration shorter than the duration of the immediately preceding interval.

4. The invention set forth in claim 1 wherein said time intervals have alternately increased and decreased durations.

5. The invention set forth in claim 1 wherein the frequency of each successive first signal is lower than that of the immediately preceding first signal.

6. The invention set forth in claim 5 wherein the frequency of each successive first signal is lower than that of all preceding first signals.

7. The invention set forth in claim 5 wherein said output section includes a piezoelectric transducer and said reminding signal is audible.

8. The invention set forth in claim 5 wherein said output section includes a vibrating member and said reminding signal is tactile.

9. The invention set forth in claim 5 wherein said output section includes means for emitting a visual reminding signal.

* * * * *